US007097112B2

(12) United States Patent
Urmson, Jr. et al.

(10) Patent No.: US 7,097,112 B2
(45) Date of Patent: Aug. 29, 2006

(54) PROFILED BAR

(75) Inventors: W. Thomas Urmson, Jr., Valencia, PA (US); John W. Mospan, Pittsburgh, PA (US); Patrick J. Boario, Allegheny Township, PA (US); Aley Copley, Jr., Scottown, OH (US); John M. Downey, Ashland, KY (US)

(73) Assignee: Protec Rail Products, Inc., Pittsburgh, PA (US)

( * ) Notice: Subject to any disclaimer, the term of this patent is extended or adjusted under 35 U.S.C. 154(b) by 0 days.

(21) Appl. No.: 10/838,173

(22) Filed: May 3, 2004

(65) Prior Publication Data

US 2005/0098647 A1 May 12, 2005

Related U.S. Application Data

(60) Provisional application No. 60/467,988, filed on May 2, 2003.

(51) Int. Cl.
*E01B 11/02* (2006.01)

(52) U.S. Cl. ..... 238/243; 238/125

(58) Field of Classification Search ..... 238/125, 238/243, 246, 151, 159, 184, 244, 262
See application file for complete search history.

(56) References Cited

U.S. PATENT DOCUMENTS 1,690,471 A * 11/1928 Breed ..... 238/243
RE18,786 E * 4/1933 Breed ..... 238/243
2,212,979 A * 8/1940 Disbrow ..... 238/243
2,238,652 A * 4/1941 Lansing ..... 238/125
2,619,290 A * 11/1952 Thomson ..... 238/125
2,936,126 A * 5/1960 Greer ..... 238/243

OTHER PUBLICATIONS

Fig. 1 Prior Art Profiled Bar manufactured by Canadian Pacific Railway/Canadian National Railway, no date.

Fig. 2 Prior Art Profiled Bar manufactured by Canadian National Railway, no date.

Fig. 3 Prior Art Profiled Bar manufactured by Canadian Pacific Railway, no date.

Fig. 4 Prior Art Profiled Bar manufactured by Jude Bar and Cleveland Truck Material, Inc. See also website at www.ClevelandTruck.com, no date.

Fig. 5 Prior Art Profiled Bar manufactured by Jude Bar and Cleveland Truck Material, Inc. See also website at www.ClevelandTruck.com, no date.

* cited by examiner

*Primary Examiner*—Mark T. Le
(74) *Attorney, Agent, or Firm*—The Webb Law Firm

(57) ABSTRACT

A rail joint made from a metallic profiled bar that is rolled or forged and is used for connecting adjacent railroad rails to each other. The rail joint is configured to provide increased wheel flange clearance while maintaining the integrity of joining two rails together.

36 Claims, 5 Drawing Sheets

PROFILED BAR

CROSS-REFERENCE TO RELATED APPLICATIONS

This application claims the benefit of U.S. Provisional Patent Application No. 60/467,988, filed May 2, 2003, which is hereby incorporated by reference in its entirety.

BACKGROUND OF THE INVENTION

1. Field of the Invention

The present invention relates to rail joints and, more particularly, to a rail joint having a rolled profiled bar.

2. Description of Related Art

Railroad rails used in the railroad industry are typically formed of a plurality of railroad rail sections joined together by rail joints. As shown in FIG. 1, a prior art rail joint 10 positioned between a first railroad rail 12 and a second railroad rail 14 is used to hold two ends 13, 15 of the railroad rails 12 and 14, respectively, in place. A plurality of holes 16 are defined in the rail joint 10, wherein the holes 16 are adapted to receive fasteners, such as a bolt and nut arrangement, for securing the rail joint 10 to the railroad rails 12, 14. The rail joint 10 prevents lateral and/or vertical movement of the rail ends 13, 15 of the railroad rails 12, 14 and permits the longitudinal movement of the railroad rails 12, 14 for expanding or contracting. Prior art rail joints have various strength requirements, as well as weight requirements set by the railroad industry. It is desirable to have a rail joint that is inexpensive to manufacture while having a maximum amount of strength for a minimum amount of weight per joint.

Further, due to technological advances in rail grinding and lubrication, present rail structures are lasting longer, thereby allowing more usable wear out of the rail heads than in the earlier constructed rail structures. This results in a decrease in distance between the rail head and a top portion of the rail joint, thus resulting in the possibility of the vehicle wheels contacting the rail joint, thereby causing premature failure of the rail joint. Therefore, it is an object of the present invention to overcome the above problems and to provide a strong rail joint that is inexpensive to manufacture.

SUMMARY OF THE INVENTION

The present invention provides for a rail joint made from a metallic bar that is rolled or forged. The rail joint includes a body having a length defined between a first end and a second end and defining a base section having a base front side and base back side, a web section having a web front side and a web back side, and a head section having a head front side and a head back side and defining an upper surface. The base section depends from the web section, and the web section depends from the head section. The web section of the body of the rail joint defines a plurality of holes for receiving fasteners. The head portion defines an abutting portion, an intermediate portion and a lug portion. A distance between the head front side and the head back side of the head section is greater than or equal to a distance between the base front side and the base back side of the base section. The strength of the rail joint as defined by the Moment of Inertia (I) is in a range of 14 to 15 $in^4$ and the weight of the rail joint is in a range of 1.5 to 1.65 pounds per inch of length of the rail joint.

The present invention also provides for a railroad rail assembly that includes a pair of abutting railroad rails and a pair of rail joints, as previously discussed, fastened to each side of the pair of railroad rails. A purpose of the present invention is to provide increased wheel flange clearance while maintaining the integrity of joining two rails together.

DETAILED DESCRIPTION OF THE INVENTION

Figure 2:
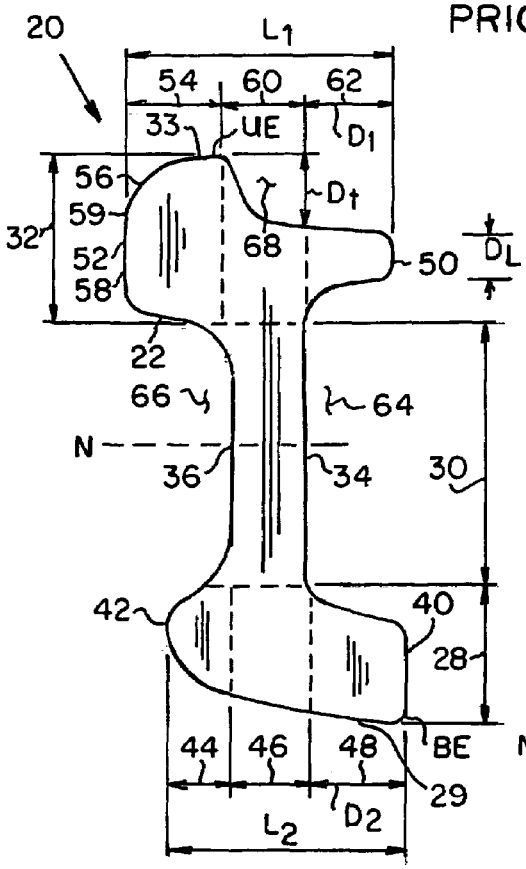
FIG. 2 is a side elevational view of a rail joint made in accordance with the present invention.

The present invention provides for a rail joint 20 made from a metallic bar that is rolled or forged. The rail joint 20 can be made of steel or other metal. Referring to FIGS. 2–6, the rail joint 20 includes a body 22 having a first end 24 and a second end 26 and defining a base section 28, a web section 30 and a head section 32. The base section 28 depends from the web section 30, and the web section 30 depends from the head section 32. The web section includes a web front side 34 and a web back side 36 and defines a plurality of holes 38 for receiving fasteners (shown in FIGS. 4 and 5). Referring to FIG. 2, the base section 28 has a bottom surface 29, a base front side 40 and a base back side 42. The base section 28 also defines a heel portion 44, a blended portion 46, and a toe portion 48. The heel portion 44 depends from the blended portion 46, and the blended portion 46 depends from the toe portion 48. The toe portion 48 extends away from the web front side 34 of the web section 30 and the heel portion 44 extends in an opposite direction from the toe portion 48 away from the web back side 36 of the web section 30. The head section 32 has an upper surface 33 and includes a head front side 50 and a head back side 52. The head section 32 defines an abutting portion 54, an intermediate portion 60 and a lug portion 62. The abutting portion 54 depends from the intermediate portion 60, and the intermediate portion 60 depends from the lug portion 62. The abutting portion 54 further defines a curved portion 56 and a straight portion 58, wherein the curved portion 56 defines a contacting surface 59. The lug portion 62 extends away from the web front side 34 of the web section 30 and the abutting portion 54 extends in an opposite direction from the lug portion 62 away from the web back side 36 of the web section 30. A front recess area 64 is defined between the lug portion 62 of the head section 32 and the toe portion 48 of the base section 28, and a back recess area 66 is defined between the abutting portion 54 of the head section 32 and the heel portion 44 of the base section 28.

With continued reference to FIG. 2, the specific design of the rail joint 20 provides the rail joint 20 with a maximum amount of strength for a minimum amount of weight. A distance $L_1$ between the head front side 50 and the head back side 52 of the head section 32 is greater than or equal to a distance $L_2$ between the base front side 40 and the base back side 42 of the base section 28 of the body 22 of the rail joint 20. The lug portion 62 extends from the web front side 34 of the web section 30 a distance $D_1$ approximately equal to a distance $D_2$ the toe portion 48 extends from the web front side 34 of the web section 30. Preferably, the distance $D_1$ is approximately within 0.125 inches or less of the distance $D_2$. A recess 68 is defined between the abutting portion 54 and the lug portion 62 on the upper surface 33 of the head section 32 of the body 22 of the rail joint 20. When the rail joint 20 is attached to a railroad rail, the recess 68 in the head section 32 is capable of receiving a wheel of a rail car riding on the railroad rail. The recess 68 preferably has a depth ($D_t$) that is sufficient to provide enough clearance for a wheel of a railcar riding on a railroad rail so as to prevent contact of the wheel on the lug portion of the head section of the body of the rail joint 20. The depth ($D_t$) for a rail joint for uses in larger rails (i.e. 132-RE, 136-RE and 141-RE) of the recess 68 can be in a range of 0.6 to 0.8 inches and preferably is 0.631 inches, and the thickness of the lug portion $D_L$ is in a range of 0.35–0.50 inches, and preferably 0.40–0.47 inches.

Figure 7:
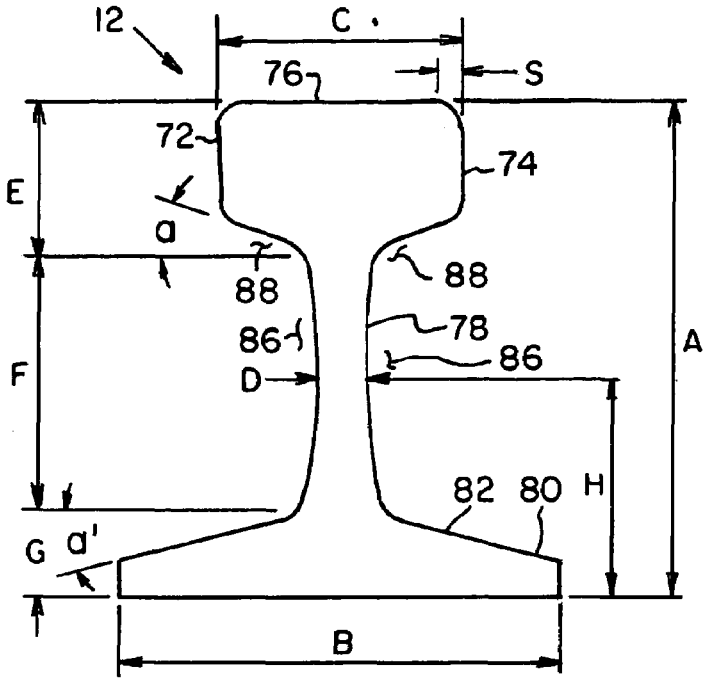
FIG. 7 PRIOR ART
FIG. 7 is a front elevational view of a typical prior art railroad rail.

Rail joint 20 can be used on any size or type of standard tee railroad rail 12 as shown in FIG. 7. However, rail joint 20 is preferably used with 132-RE, 136-RE and 141-RE rails according to the American Railway Engineering and Maintenance Way Association (AREMA) specifications. Referring to FIG. 7, railroad rail 12 that includes a body 72 having a head 74, a web 78, and a base 80 having an upper surface 82. The head 74 having a top surface 76 is connected to the web 78, which is connected to the base 80. The web 78 defines a plurality of slots 84 (shown in phantom in FIG. 8) for receiving fasteners. A web recess 86 is defined between the head 74 and the base 80 on each side of the railroad rail 12 and a rail head recess 88 is defined between the head 74 and the web 78 on each side of the railroad rail 12. The dimensions of the railroad rail 12, designated by the letters A-H, can vary depending on the size and type of rail required for a particular need. For example, a railroad rail having the 136-RE designation weighs 136 pounds per yard and includes the following dimensions in inches as shown in FIG. 7: Height (A) of railroad rail is 7 5/16; Width (B) of base 80 is 6; Width (C) of head 74 is 2 15/16; Thickness (D) of web 78 at center is 11/16; Depth (E) of head 74 is 1 15/16; Height (F) of web 78 is 4 3/16; Head angle (a) is 1 to 4 degrees; Base angle (a') is 1 to 4 degrees; Slope (s) of head 74 is 1 to 40 degrees; and Height (H) of slot 84 is 3 3/32.

Referring to FIGS. 2–6, it has been found that the specific shape and dimensions of the rail joint 20 results in improved strength characteristics when used with the preferred railroad rails. The strength of the rail joint 20 can be defined by the Moment of Inertia (I) and the Section Modulus (Z). "Moment of Inertia (I)" is defined as the capacity of a cross-section to resist bending, and can be expressed in inches to the fourth power ($in^4$). Section Modulus (Z) relates bending moment and maximum bending stress within the elastic range and can be expressed in inches to the third power ($in^3$). The "elastic range" is where the working stress does not exceed the elastic limit and the "elastic limit" is the maximum stress to which a structural member may be subjected and still return to its original length upon release of the load. Section Modulus (Z) can be expressed mathematically as: Z=I/c; wherein (I) is the Moment of Inertia of the cross-section about a neutral axis (N), and (c) is the distance from the neutral axis (N) to the outermost fibers.

The rail joint 20 when used with the preferred railroad rails (i.e., 132-RE, 136-RE and 141-RE) preferably has a length of 36 inches from the first end 24 to the second end 26 of the rail joint 20 and includes six holes 38 (partially shown in FIGS. 4 and 5) for receiving fasteners. Referring to FIG. 2, the rail joint 20 preferably includes the following dimensions: Moment of Inertia (I) in a range of 14–15 $in^4$ (preferably 14.02–14.07 $in^4$); a top Section Modulus (Z) as defined from the neutral axis N to an upper end UE of the head section 32 in a range of 5.3–5.7 $in^3$ (preferably 5.54–5.57 $in^3$); and a bottom Section Modulus (Z) as defined from the neutral axis N to a bottom end BE of the base section 28 in a range of 5.3–5.7 $in^3$ (preferably 5.59–5.61 $in^3$). Preferably, the cross-sectional area is in a range of 5.6–5.7 $in^2$ (preferably 5.63–5.66 $in^2$) and the rail joint 10 has a weight in a range of 1.5–1.65 pounds per inch of length (preferably 1.59–1.60 pounds per inch). Preferably, the neutral axis N is about 2.53 inches from the upper end UE of the head section 32 and 2.51 inches from a bottom end BE of the base section 28 of the rail joint 20.

The rail joint 20 when used with preferred smaller rails (i.e. 115-RE and 119-RE) preferably has a length of 36 inches from the first end 24 to the second end 26 of the rail joint 20 and includes six holes 38 (partially shown in FIGS. 4 and 5) for receiving fasteners. Referring to FIG. 2, the rail joint 20 preferably includes the following dimensions: Moment of Inertia (I) in the range of 10–11 $in^4$ (preferably 10.24 $in^4$); a top Section Modulus (Z) in the range of 4.3–4.5 $in^3$ (preferably 4.44 $in^3$); the bottom Section Modulus (Z) 4.3–4.5 $in^3$ (preferably 4.45 $in^3$). Preferably, the cross-sectional area is in the range of 5.0–5.2 $in^2$ (preferably 5.12 $in^2$) and the rail joint 10 has a weight in a range of 1.4–1.5 pounds per inch of length (preferably 1.45 pounds per inch). Preferably, the neutral axis N is about 2.31 inches from the upper end UE of the head section 32 and 2.30 inches from the bottom end BE of the base section 28 of the rail joint 20. The depth ($D_t$) of the recess 68 is within the range 0.550–0.700 inches and preferably 0.575 inches and the lug thickness $D_L$ is within a range of 0.35–0.45 inches, preferably 0.38–0.43 inches.

Figure 2A:
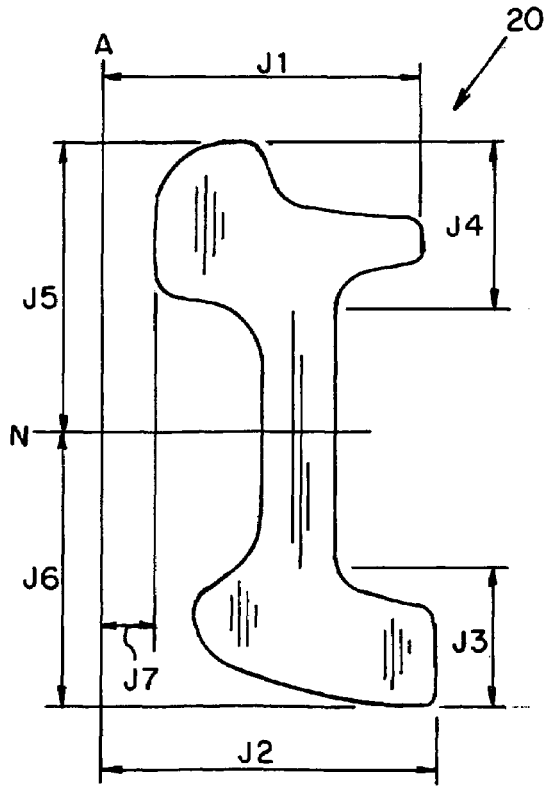
FIG. 2*a* is a side elevational view of the rail joint shown in FIG. 2 having dimension lines.
Figure 3:
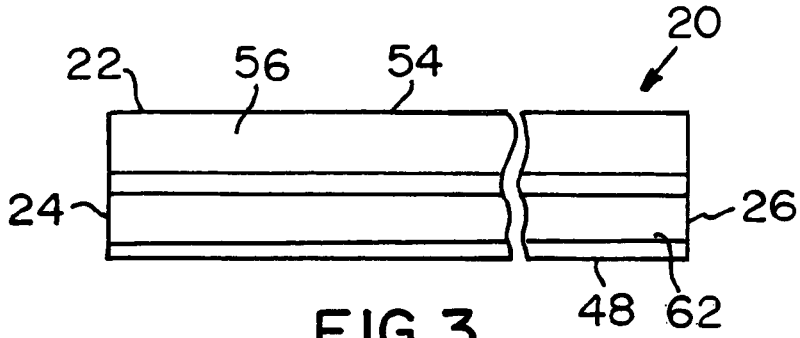
FIG. 3 is a top plan view, partially in section, of the rail joint shown in FIG. 2.
Figure 4:
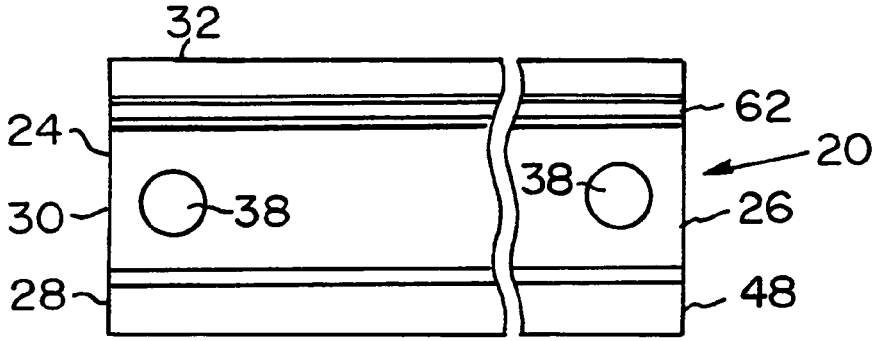
FIG. 4 is a right side elevational view, partially in section, of the rail joint shown in FIG. 2.
Figure 5:
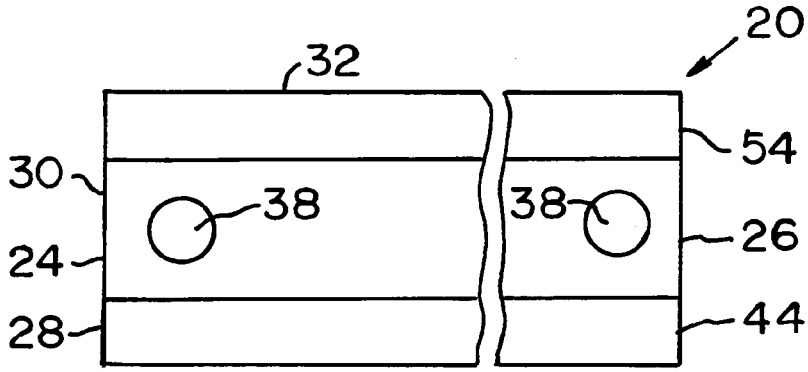
FIG. 5 is a left side elevational view, partially in section, of the rail joint shown in FIG. 2.
Figure 6:
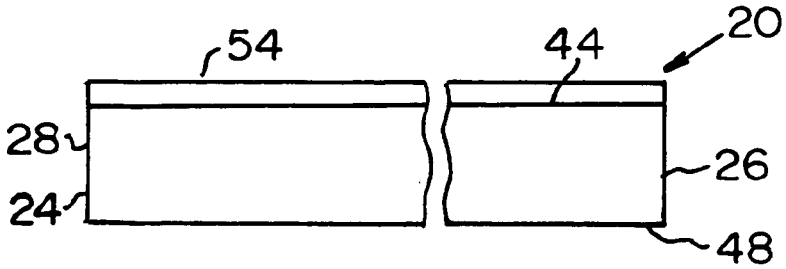
FIG. 6 is a bottom plan view, partially in section, of the rail joint shown in FIG. 2.

FIG. 2*a* shows the rail joint 20 having dimensions designated as J1–J7. Table 1 shows the dimensions (J1–J7) of various size rail joints 20 along with the strength properties for the specific rail joint dimensions. The first two examples are for rail joints for railroad rails 132-RE, 136-RE and 141-RE. The last example is for a rail joint for railroad rails 115-RE and 119-RE. The dimensions are defined as follows: J1 is the length of the head section 32 from a central axis A; J2 is the length of the base section 28 from a central axis A; J3 is the height of the base section 28; J4 is the height of the head section 32; J5 is the distance from a neutral axis N to a top of the rail joint 20; J6 is the distance from a neutral axis N to a bottom of the rail joint 20; and J7 is the horizontal distance between central axis A and a longitudinal axis that first contacts the head section 32. The strength properties include Moment of Inertia (I), top Section Modulus $(Z)_{top}$, bottom Section Modulus $(Z)_{bot}$, and weight in pounds per inch of length of the rail joint.

TABLE 1

| J1 (in) | J2 (in) | J3 (in) | J4 (in) | J5 (in) | J6 (in) | J7 (in) | I ($in^4$) | $Z_{top}$ ($in^3$) | $Z_{bot}$ ($in^3$) | Weight (lbs/in) |
|---|---|---|---|---|---|---|---|---|---|---|
| 2.747 | 2.879 | 1.260 | 1.327 | 2.53 | 2.51 | 0.405 | 14.04 | 5.55 | 5.60 | 1.60 |
| 2.747 | 2.879 | 1.260 | 1.217 | 2.53 | 2.51 | 0.405 | 14.02 | 5.54 | 5.59 | 1.59 |
| 2.624 | 2.624 | 1.150 | 1.241 | 2.31 | 2.30 | 0.378 | 10.24 | 4.44 | 4.45 | 1.45 |

Figure 8:
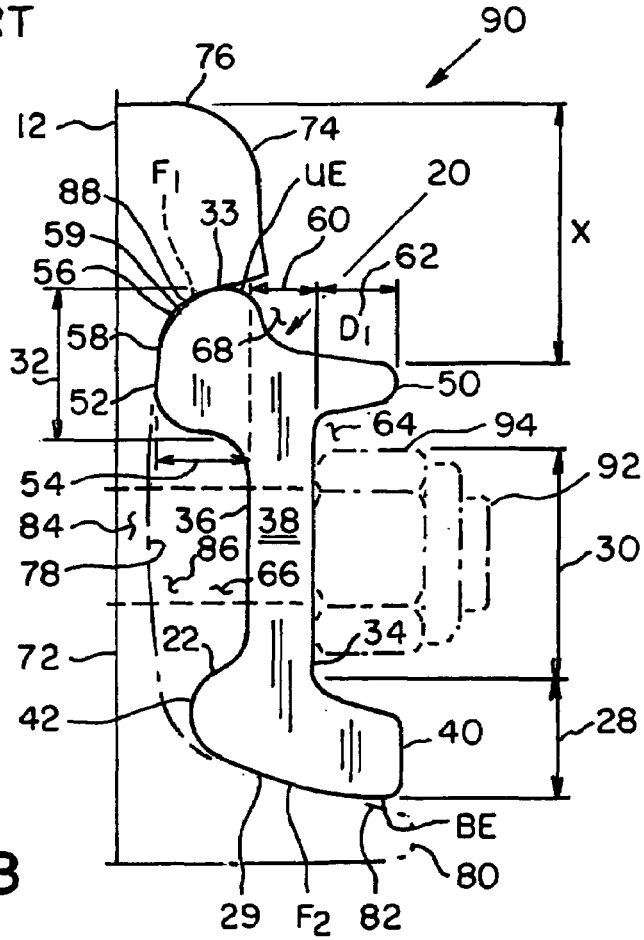
FIG. 8 is a side elevational view of the rail joint shown in FIG. 2 co-acting with a railroad rail.

FIG. 8 shows a rail joint arrangement 90 wherein rail joint 20 is attached to a railroad rail 12. Referring to FIG. 8, the base back side 42 of the base section 28, the web back side 36 of the web section 30, and the head back side 52 of the head section 32 of the body 22 of the rail joint 20 is received within the web recess 86 of the body 22 of the railroad rail 12. The contacting surface 59 of curved portion 56 of the abutting portion 54 of the rail joint 20 abuts against a surface of the railroad rail 12 within the rail head recess 88, thus defining a first fishing surface $F_1$. The bottom surface 29 of the base section 28 abuts against the upper surface 82 of the base 80 of the railroad rail 12, thus defining a second fishing surface $F_2$. By "fishing surface" is meant a surface where the rail joint 20 contacts a surface of a railroad rail. It has also been found that the rail joint 20 should be positioned a distance X between the top surface 76 of the railroad rail 12 and the upper surface 33 of the lug portion 62 in order to minimize the possibility of contact between rail wheels and the rail joint 10. For example, the distance X is preferably, for larger rails, at least 2.0 inches, and, more preferably, 2.17 inches for a 132-RE rail, 2.37 inches for a 136-RE rail, and 2.52 inches for a 141-RE rail. The distance X is preferably, for smaller rails, at least 2.0 inches and, more preferably, 2.05 inches for a 115-RE rail and 2.24 inches for a 119-RE rail. It has been found that the present design maximizes Moment of Inertia (I) and minimizes weight of the rail joint 20 while providing additional wheel flange clearance over prior art rail joints resulting in a superior rail joint.

Figure 1:
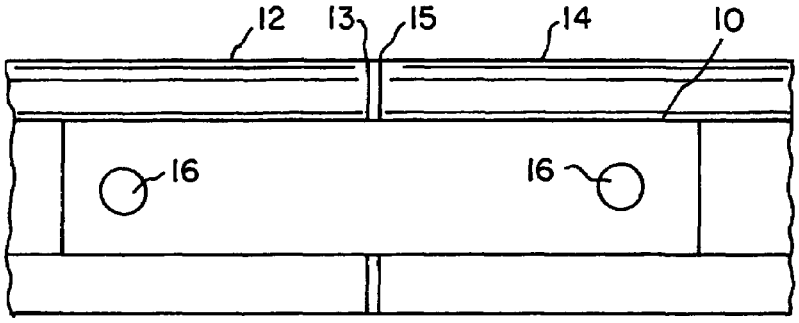
FIG. 1 PRIOR ART
FIG. 1 is a right side elevational view of a prior art rail joint connecting two adjacent railroad rails together.
Figure 9:
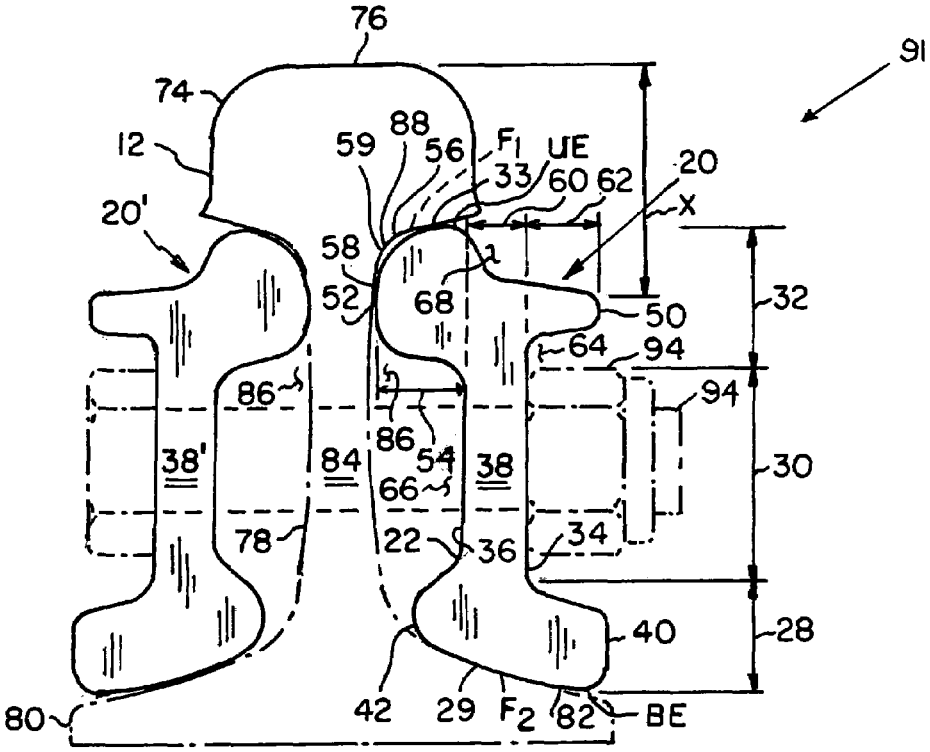
FIG. 9 is a side elevational view of a rail joint assembly made in accordance with the present invention.

FIG. 9 shows a rail joint assembly 91 made in accordance with the present invention. Referring to FIGS. 8 and 9, the assembly includes a pair of rail joints 20, 20', as previously discussed, attached to each side of a pair of abutting railroad rails 12, 14 (shown in FIG. 1). A fastener 92, such as a nut and bolt arrangement, passes through the hole 38 in rail joint 20, slot 84 in railroad rail 12, and a corresponding hole 38' in rail joint 20' and a nut 94 is received by the fastener 92 so as to attach the rail joints 20, 20' against each side of the adjacent railroad rail 12.

Figure 10:
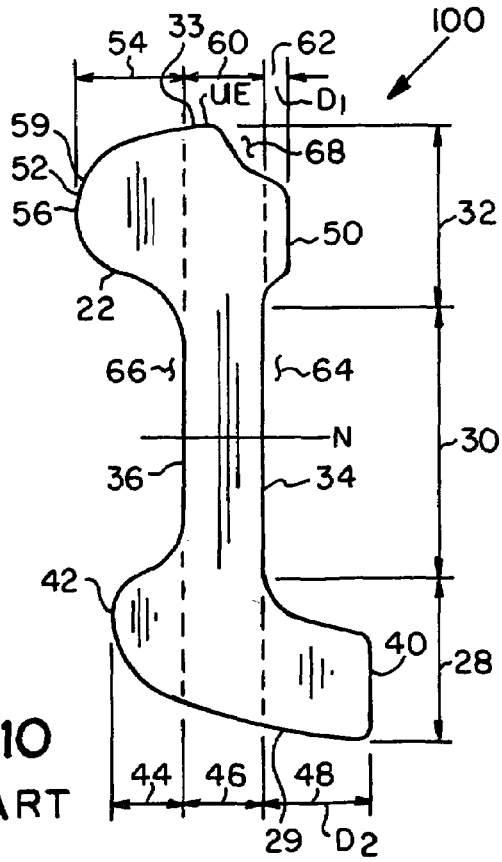
FIG. 10 PRIOR ART
FIG. 10 is a side elevational view of a prior art rail joint profile.

FIG. 10 shows a prior art rolled rail joint 100, resulting in a weaker rail joint 100 compared to rail joint 20. The prior art rail joint 100 is similar to rail joint 20, except for the differences noted below. Like reference numerals are used for like parts. The prior art rail joint 100 includes a body 22 having a base section 28, a web section 30, and a head section 32. The shape of the web section 30 and the base section 28 of the prior art rail joint 100 are substantially similar to the web section 30 and base section 28 of rail joint 20. The head section 32 of rail joint 100 also includes an abutting portion 54, an intermediate portion 60, and a lug portion 62. However, the abutting portion 54 of rail joint 100 includes only a curved portion 56 and not a straight portion 58 as in rail joint 20, thereby resulting in a weaker rail joint. Further, the distance $D_1$ the lug portion 62 of rail joint 100 extends outwardly relative to the toe portion 48 of the base section 28 is substantially less than the distance $D_1$ the lug portion 62 of rail joint 20 extends outwardly relative to the toe portion 48.

Figure 11:
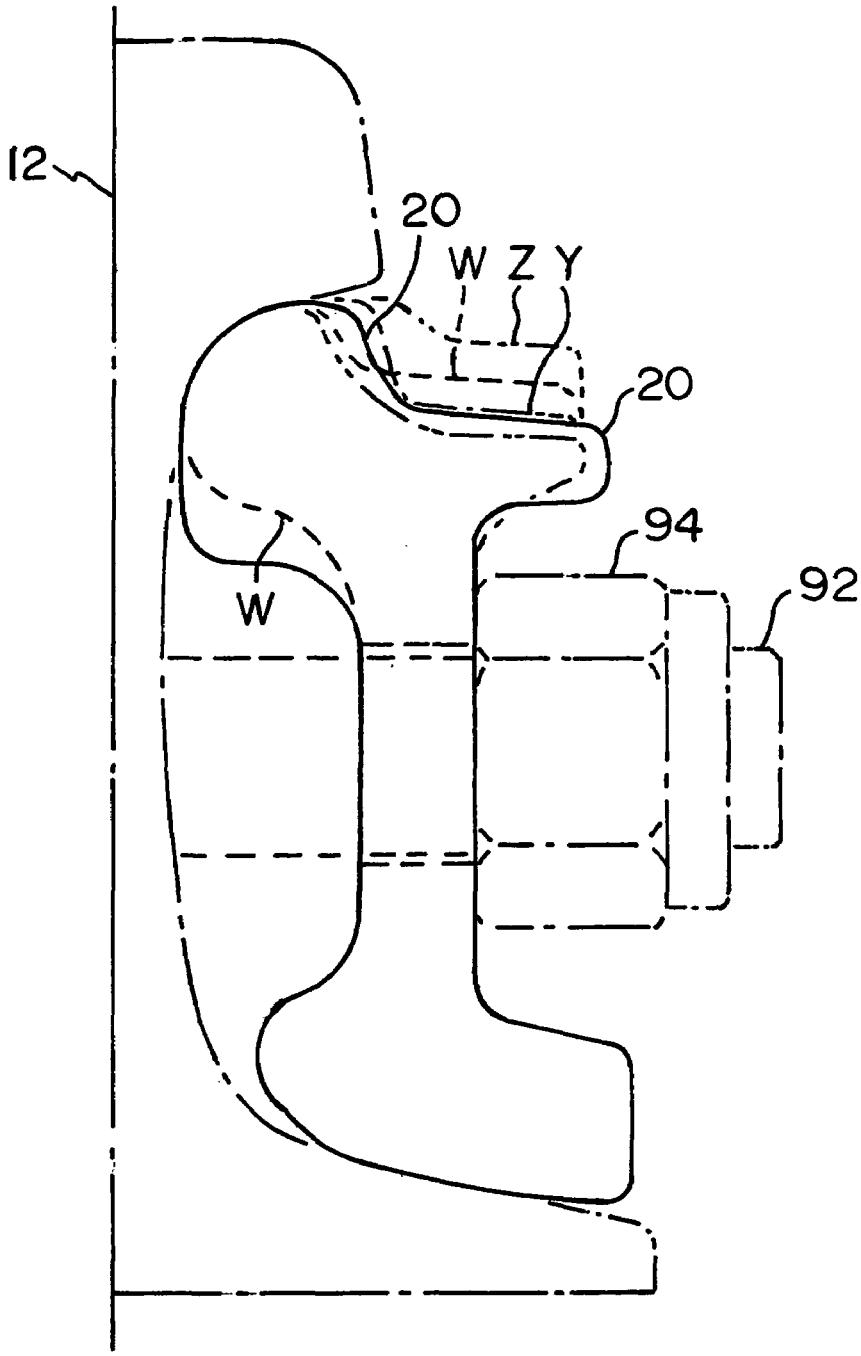
FIG. 11 is a side elevational view of the rail joint shown in FIG. 2 and prior art rail joint profiles co-acting with a railroad rail.

FIG. 11 also shows other prior art rail joint profiles W, Y and Z (shown in phantom) attached to a railroad rail 12. All of these joints are at least partially machined. Further, the shape of the head sections of the prior art rail joint profiles W, Y and Z, particularly the lug portions, does not extend as far as the lug portion 62 of rail joint 20. The shape and dimensions of the present rail joint 20 are such that it can be rolled or forged, without any machinery, except for the bolt holes. This results in a stronger and less expensive rail joint having the same diameters of rail joints that are machined. The rail joint 20 begins with a forged billet that is rolled through various rolling stands resulting in the final profile, for example, steel having a minimum 125,000 psi tensile strength and a minimum 88,000 yield strength is preferred. Stronger steel having a higher tensile strength and higher yield strength can be used to compensate for resulting losses in mechanical properties of inertia and section modulus over prior art joints.

It will be readily appreciated by those skilled in the art that modifications may be made to the invention without departing from the concepts disclosed in the foregoing description. Accordingly, the particular embodiments described in detail herein are illustrative only and are not limiting as to the scope of the invention, which is to be given the full breadth of the appended claims and any and all equivalents thereof.

The invention claimed is:

1. A rail joint comprising:

a body having a length defined between a first end and a second end and defining a base section having a base front side and base back side, a web section having a web front side and a web back side, and a head section having a head front side and a head back side, said base section depends from said web section, and said web section depends from said head section, wherein a distance between said head front side and said head back side of said head section is greater than or equal to a distance between said base front side and said base back side of said base section, and wherein the Moment of Inertia (I) of the rail joint is in a range of 14 to 15 $in^4$ and the weight of the rail joint is in a range of 1.5 to 1.65 pounds per inch of length of said rail joint.

2. The rail joint as claimed in claim 1, wherein said head section having an upper surface defines an abutting portion, an intermediate portion and a lug portion, said abutting portion depends from said intermediate portion and said intermediate portion depends from said lug portion, wherein said lug portion extends away from said web front side of said web section and said abutting portion extends in an opposite direction from said lug portion away from said web back side of said web section.

3. The rail joint as claimed in claim 2, wherein said abutting portion defines a curved portion and a straight portion.

4. The rail joint as claimed in claim 1, wherein said base section defines a heel portion, a blended portion, and a toe portion, said heel portion depends from said blended portion, and said blended portion depends from said toe portion, wherein said toe portion extends away from said web front side of said web section and said heel portion extends in an opposite direction from said toe portion away from said web back side of said web section.

5. The rail joint as claimed in claim 2, wherein said base section defines a heel portion, a blended portion, and a toe portion, said heel portion depends from said blended portion, and said blended portion depends from said toe portion, wherein said toe portion extends away from said web front side of said web section and said heel portion extends in an opposite direction from said toe portion away from said web back side of said web section.

6. The rail joint as claimed in claim 5, wherein said lug portion extends from said web front side of said web section a distance approximately equal to a distance said toe portion extends from said web front side of said web section.

7. The rail joint as claimed in claim 5, wherein a front recess area is defined between said lug portion of said head section and said toe portion of said base section, and a back recess area is defined between said abutting portion of said head section and said heel portion of said base section.

8. The rail joint as claimed in claim 2, wherein a recess is defined between said abutting portion and said lug portion on the upper surface of said head section, and wherein a distance between the upper surface of said abutting portion and said lug portion of said head section is sufficient to provide clearance of a wheel of a railcar riding on a rail so as to prevent contact of the wheel on said lug portion of said head section.

9. The rail joint as claimed in claim 8, wherein the distance between the upper surface of said abutting portion and said lug portion of said head section is in a range of 0.6 to 0.8 inches.

10. The rail joint as claimed in claim 1, wherein a plurality of holes for receiving fasteners are defined in said web section of said body of the rail joint.

11. The rail joint as claimed in claim 1, wherein a top Section Modulus and a bottom Section Modulus of the rail joint are in a range of 5.3 to 5.7 $in^3$ and having a cross-sectional area in a range of 5.6 to 5.7 $in^2$.

12. The rail joint as claimed in claim 1, wherein a thickness of said lug portion of said head section of said body of the rail joint is in a range of 0.35 to 0.50 inches.

13. The rail joint as claimed in claim 1, wherein the rail joint is made of a unitary piece of forged or rolled metal.

14. The rail joint as claimed in claim 13, wherein the rail joint is made of steel.

15. The rail joint as claimed in claim 1, wherein the length defined between said first end and said second end of said body of the rail joint is at least 36 inches.

16. A rail joint assembly comprising:

a pair of abutting railroad rails having a first side and a second side, each of said railroad rails having a body and defining a head, a web and a base, the head having a top surface connected to the base via the web, the web defines a plurality of slots for receiving fasteners; and a pair of rail joints, wherein a first rail joint is attached to said first side of said pair of rail sections and a second rail joint is attached to said second side of said pair of rail sections, each rail joint comprising a body having a length defined between a first end and a second end and defining a base section having a base front side and base back side, a web section having a web front side and a web back side, and a head section having a head front side and a head back side, said base section depends from said web section, and said web section depends from said head section, said web section of said body defining a plurality of holes, said head section having an upper surface defines an abutting portion, an intermediate portion and a lug portion, wherein a distance between said head front side and said head back side of said head section is greater than or equal to a distance between said base front side and said base back side of said base section, and wherein the Moment of Inertia (I) of the rail joint is in a range of 14 to 15 $in^4$ and the weight of the rail joint is in a range of 1.5 to 1.65 pounds per inch of length of said rail joint.

17. The rail joint assembly as claimed in claim 16, further comprising a plurality of fasteners for securing said rail joints to said railroad rails via a fastener passing through each hole in said first rail joint and said second rail joint and each slot in said railroad rails.

18. The rail joint assembly as claimed in claim 16, wherein the distance between the top surface of the head of the railroad rail and the upper surface of said lug portion of said head section of said body of each of said rail joints is at least 2.0 inches.

19. A rail joint comprising:

a body having a length defined between a first end and a second end and defining a base section having a base front side and base back side, a web section having a web front side and a web back side, and a head section having a head front side and a head back side, said base section depends from said web section, and said web section depends from said head section, wherein a distance between said head front side and said head back side of said head section is greater than or equal to a distance between said base front side and said base back side of said base section, and wherein the Moment of Inertia (I) of the rail joint is in a range of 10 to 11 $in^4$ and the weight of the rail joint is in a range of 1.4 to 1.5 pounds per inch of length of said rail joint.

20. The rail joint as claimed in claim 19, wherein said head section having an upper surface defines an abutting portion, an intermediate portion and a lug portion, said abutting portion depends from said intermediate portion and said intermediate portion depends from said lug portion, wherein said lug portion extends away from said web front side of said web section and said abutting portion extends in an opposite direction from said lug portion away from said web back side of said web section.

21. The rail joint as claimed in claim 20, wherein said abutting portion defines a curved portion and a straight portion.

22. The rail joint as claimed in claim 19, wherein said base section defines a heel portion, a blended portion, and a toe portion, said heel portion depends from said blended portion, and said blended portion depends from said toe portion, wherein said toe portion extends away from said web front side of said web section and said heel portion extends in an opposite direction from said toe portion away from said web back side of said web section.

23. The rail joint as claimed in claim 20, wherein said base section defines a heel portion, a blended portion, and a toe portion, said heel portion depends from said blended portion, and said blended portion depends from said toe portion, wherein said toe portion extends away from said web front side of said web section and said heel portion extends in an opposite direction from said toe portion away from said web back side of said web section.

24. The rail joint as claimed in claim 23, wherein said lug portion extends from said web front side of said web section a distance approximately equal to a distance said toe portion extends from said web front side of said web section.

25. The rail joint as claimed in claim 23, wherein a front recess area is defined between said lug portion of said head section and said toe portion of said base section, and a back recess area is defined between said abutting portion of said head section and said heel portion of said base section.

26. The rail joint as claimed in claim 20, wherein a recess is defined between said abutting portion and said lug portion on the upper surface of said head section, and wherein a distance between the upper surface of said abutting portion and said lug portion of said head section is sufficient to provide clearance of a wheel of a railcar riding on a rail so as to prevent contact of the wheel on said lug portion of said head section.

27. The rail joint as claimed in claim 26, wherein the distance between the upper surface of said abutting portion and said lug portion of said head section is in a range of 0.55 to 0.7 inches.

28. The rail joint as claimed in claim 19, wherein a plurality of holes for receiving fasteners are defined in said web section of said body of the rail joint.

29. The rail joint as claimed in claim 19, wherein a top Section Modulus and a bottom Section Modulus of the rail joint is in a range of 4.3 to 4.5 $in^3$ and having a cross-sectional area in a range of 5.0 to 5.2 $in^2$.

30. The rail joint as claimed in claim 19, wherein a thickness of said lug portion of said head section of said body of the rail joint is in a range of 0.35 to 0.45 inches.

31. The rail joint as claimed in claim 19, wherein the rail joint is made of a unitary piece of forged or rolled metal.

32. The rail joint as claimed in claim 31, wherein the rail joint is made of steel.

33. The rail joint as claimed in claim 19, wherein the length defined between said first end and said second end of said body of the rail joint is at least 36 inches.

34. A rail joint assembly comprising:

a pair of abutting railroad rails having a first side and a second side, each of said railroad rails having a body and defining a head, a web and a base, the head having a top surface connected to the base via the web, the web defines a plurality of slots for receiving fasteners; and a pair of rail joints, wherein a first rail joint is attached to said first side of said pair of rail sections and a second rail joint is attached to said second side of said pair of rail sections, each rail joint comprising a body having a length defined between a first end and a second end and defining a base section having a base front side and base back side, a web section having a web front side and a web back side, and a head section having a head front side and a head back side, said base section depends from said web section, and said web section depends from said head section, said web section of said body defining a plurality of holes, said head section having an upper surface defines an abutting portion, an intermediate portion and a lug portion, wherein a distance between said head front side and said head back side of said head section is greater than or equal to a distance between said base front side and said base back side of said base section, and wherein the Moment of Inertia (I) of the rail joint is in a range of 10 to 11 $in^4$ and the weight of the rail joint is in a range of 1.4 to 1.5 pounds per inch of length of said rail joint.

35. The rail joint assembly as claimed in claim 34, further comprising a plurality of fasteners for securing said rail joints to said railroad rails via a fastener passing through each hole in said first rail joint and said second rail joint and each slot in said railroad rails.

36. The rail joint assembly as claimed in claim 34, wherein the distance between the top surface of the head of the railroad rail and the upper surface of said lug portion of said head section of said body of each of said rail joints is at least 2.0 inches.

* * * * *